US007066423B2

(12) United States Patent
Andersson

(10) Patent No.: US 7,066,423 B2
(45) Date of Patent: Jun. 27, 2006

(54) SOLID ROLLS DISPENSER

(75) Inventor: Anders Andersson, Stenungsund (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 10/739,352

(22) Filed: Dec. 19, 2003

(65) Prior Publication Data

US 2004/0129825 A1 Jul. 8, 2004

Related U.S. Application Data

(60) Provisional application No. 60/434,403, filed on Dec. 19, 2002.

(51) Int. Cl.
*B65H 75/18* (2006.01)

(52) U.S. Cl. ..... 242/599.3; 242/596.7; 242/596.8

(58) Field of Classification Search ..... 242/596.5, 242/596.7, 596.8, 588.6, 599.3; 312/34.8
See application file for complete search history.

(56) References Cited

U.S. PATENT DOCUMENTS

| | | | | |
|---|---|---|---|---|
| 2,146,038 | A * | 2/1939 | West | 242/596.3 |
| 5,060,882 | A * | 10/1991 | Rousculp et al. | 242/599.3 |
| 5,370,339 | A | 12/1994 | Moody et al. | |
| 5,501,415 | A * | 3/1996 | Harris et al. | 242/596.7 |
| 5,833,169 | A * | 11/1998 | Morand | 242/596.8 |
| 6,082,664 | A | 7/2000 | Phelps et al. | |
| 6,092,759 | A | 7/2000 | Gemmell et al. | |
| 6,138,939 | A | 10/2000 | Phelps et al. | |
| 6,161,795 | A | 12/2000 | Skerrett et al. | |
| 6,382,553 | B1 | 5/2002 | Lewis et al. | |
| 6,502,781 | B1 * | 1/2003 | Tramontina | 242/596.5 |
| 6,536,696 | B1 * | 3/2003 | Fiutak et al. | 242/596.4 |

FOREIGN PATENT DOCUMENTS

| | | |
|---|---|---|
| EP | 0 729 724 | 9/1996 |
| WO | WO 99/60909 | 12/1999 |

OTHER PUBLICATIONS

Patent Abstracts of Japan, vol. 1998, No. 11, Sep. 30, 1998 & JP 10 167432 A (Ishikawajima Harima Heavy Ind Co Ltd), Jun. 23, 1998 abstract.

* cited by examiner

*Primary Examiner*—William A. Rivera
(74) *Attorney, Agent, or Firm*—Young & Thompson

(57) ABSTRACT

A dispenser for solid rolls of web material, includes a frame, a cover connectable to the frame, to together with the frame define a volume for storing a roll of web material from which web material can be dispensed, a frame roll support projection, and a cover roll support projection, the two roll support projections being arranged to enable rotatably engaging the roll of web material in or near its rotational axis, an outlet opening in the dispenser, to enable web material to be withdrawn from the dispenser, where at least one of the frame or cover roll support projections is rotatably mounted in a bearing.

20 Claims, 4 Drawing Sheets

A–A

SOLID ROLLS DISPENSER

CROSS REFERENCE TO RELATED APPLICATION

The application claims the benefit of U.S. Provisional Application No. 60/434,403 filed on Dec. 19, 2002.

FIELD OF THE INVENTION

This invention concerns a dispenser for tissue paper from solid rolls.

BACKGROUND OF THE INVENTION

Tissue papers have a wide use as toilet papers and paper towels in roll form, both for household and commercial uses. In households normally small rolls with a diameter of 100 to 150 mm are used, but the length of a paper roll then of course is limited, especially as the market trend is going towards more soft and bulky tissue paper.

In commercial use, in offices and in public washrooms etc, the handling cost of exchanging empty or near-empty rolls with fresh ones, or letting the user be disappointed at the lack of paper is of concern. This has led to tests with dispensers for rolls of paper that will last far longer.

These large rolls, often called jumbo rolls, can have a diameter of 200 to 350 mm and will thus carry a lot more paper. They will be correspondingly heavier than smaller rolls which weigh 0.1–0.2 kg, with a weight of from 0.2 to 2.0 or even 2.5 kg, and they can carry 1000 m of tissue paper.

Traditionally, rolled tissue papers have been rolled up on a core of cardboard to ascertain a hole in the middle which will allow the use of a central pin used in many dispensers. This core then has to be taken away and discarded when all the tissue paper from the roll has been used.

New market trends have introduced the coreless roll, where there is no cardboard roll around which the first windings has been started, but the roll has been produced on some type of mandrel so there is a hole, which often may have collapsed so that it has a deformed shape; it can be oval, flattened or star shaped. Normally the first windings are attached to each other by addition of some water to act like a core. All the paper can be used from such a roll, and no core has to be discarded.

WO 99/60909 teaches a method of holding a small coreless roll in a dispenser with plungers extending from the sides of the dispenser. The roll has to be prepared, preferably at the time of production, with depressions in each side, for the ends of the plungers to fit therein.

Some problems are known for cored and coreless rolls: the resulting hole can have an oval shape, or its diameter can vary with air moisture content, or the hole can become damaged at the edge, which problems can make it difficult to fit the roll in the dispenser, or the roll might wobble in the dispenser as paper is drawn from it.

A new trend is emerging with solid rolls, where even the innermost part is filled with paper and there is no hole, both for small rolls and for large jumbo rolls. This will for a given outer diameter result in more meters of paper on the roll. No central hole can be damaged, as there is none.

Special types of dispensers are needed to handle these types of rolls.

U.S. Pat. No. 6,082,664 teaches a method to hold small solid or coreless rolls in an adapter to be placed in a dispenser for cored rolls where short stubs or protrusions from the adapter are to be pressed into recesses (or divots) formed in the sides of the roll. These recesses should be formed at the time of production.

U.S. Pat. No. 6,161,795 shows a solid jumbo roll resting on two drive rolls. The tissue paper drawn from the jumbo roll is led through a channel formed by two belts driven by the force of the pulled tissue paper. This will also turn the jumbo roll and the drive rolls. At the end of the channel the belts form a nip which will cause the paper to be broken when pulled. All force needed to rotate the belts and the jumbo roll is actuated through the tissue paper. If the paper breaks just in the nip, there will be no easily pulled paper end to catch.

JP 10-167,432 teaches the use of an electrical motor to rotate a solid jumbo roll via a belt driving the periphery of a roll coupling a required distance to dispense a piece of paper. What the patentee here calls a jumbo roll really is a mother roll, but the teaching could be possible to use for a jumbo roll too.

The sheer size and weight of jumbo rolls make many standard dispenser solutions inappropriate. The roll needs to be installed alongside a wall. The weight of the roll necessitates a sturdy holding mechanism. The paper outlet most often needs to be placed at a low point of the dispenser. It is difficult to use a perforated tissue paper for jumbo rolls, as the perforation will lessen its strength.

There is a need for a simple and reliable method of installing and holding solid rolls in a dispenser, without complicated mechanisms. There is also a need for a dispenser for solid rolls which allows a simple and reliable method of operation. The need is more pronounced for larger and jumbo rolls.

These large rolls need to be protected from pilfering, so that an ill-advised user cannot take out a roll with a substantial amount of paper left on it.

SUMMARY OF THE INVENTION

It is an object of the present invention to provide an improved dispenser for solid paper rolls.

This is according to the invention accomplished by providing a dispenser for solid rolls of web material, comprising a frame, a cover connectable to the frame, which together with the frame define a volume for storing a web material roll from which web material can be dispensed, a frame roll support projection, and a cover roll support projection, the two roll support projections being arranged to enable rotatably engaging the web material roll in or near its rotational axis, an outlet opening in the dispenser, to enable web material to be withdrawn from the dispenser, wherein at least one of the frame or cover roll support projections is rotatably mounted in a bearing.

This bearing will enable the roll to rotate in a smooth way even if it is gripped very hard by projections penetrating and locking into the paper windings at the center of the roll. The rotation will be inside the bearing and not in the surface between the paper and the holding mechanism, e.g. a stub or protrusion.

In a preferred embodiment of the invention both the frame and cover roll support projections are rotatably mounted in bearings.

The bearing of the invention is chosen from the group of roller bearings, needle bearings, ball bearings, and plain bearings.

In a preferred embodiment of the invention at least one of the roll support projections has a projection part that is adapted to penetrate into the center of the roll. This projection part should preferably have a pointed end and a tapering shape. The cross section of the projection part is circular, oval, triangular or rectangular.

In a preferred embodiment of the invention the frame roll support projection part has a diameter of 5–9 mm at its base and a length of 30–40 mm.

A preferred embodiment of the invention has the added function that the cover roll projection part is temporarily retractable from a roll-engaging position to a non-roll-engaging position.

The dispenser of the invention is especially suited for use with jumbo rolls, weighing at least 500 g.

DETAILED DESCRIPTION OF THE INVENTION

Figure 1:
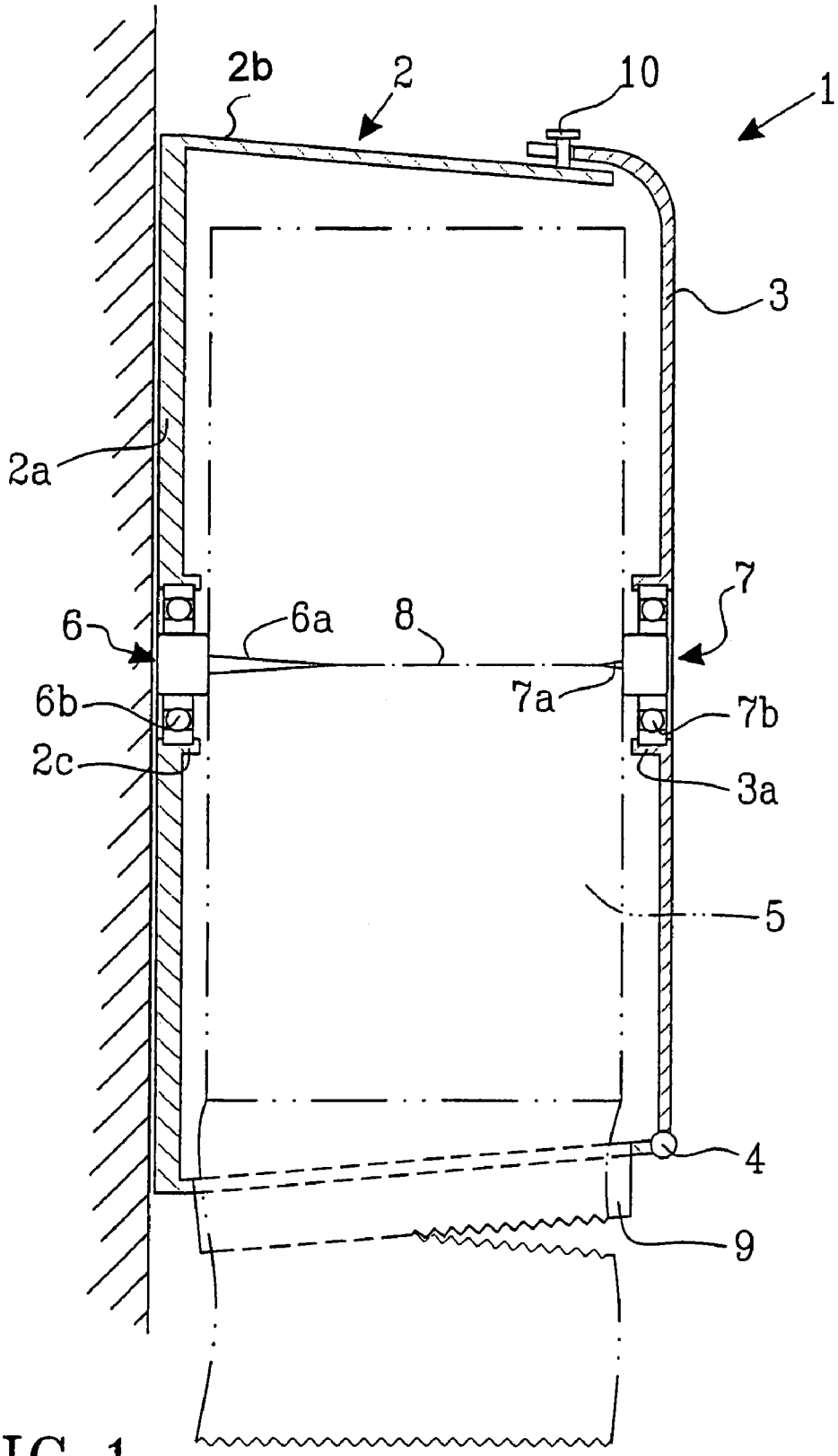
FIG. 1 A view through the vertical center line of a tissue paper dispenser according to the invention.

The invention now will be described more in detail, referring to the drawings.

In FIG. 1 is shown a dispenser 1 according to the invention. A frame 2 has a back plate 2*a* and a generally circular side wall 2*b*.The back plate is preferably equipped with holes for screwing or bolting the dispenser to a wall in a wash room, etc. At the lower part of the side wall there is an opening 9 for dispensing the tissue paper.

Connected to the frame 2 by a hinge 4 a cover 3 is movable between an open position, enabling the installation of a new paper roll 5 from which is to be dispensed tissue paper, and a closed position, to be used during the actual dispensing. Preferably the cover 3 is kept in the closed position by a lock 10, that also protects the dispenser from pilfering.

In the back plate 2*a* of the frame 2 a frame roll support projection 6 has been fitted. This includes a projection part 6*a* which is adapted to project partly into the side of a solid roll. Production of a solid roll without use of any core or mandrel results in a roll where even the innermost part is filled with paper. The projection part 6*a* will then when a new roll 5 is loaded into the dispenser be forced to penetrate between some tissue paper layers at the center of the solid roll.

In a corresponding way, the cover 3 has been fitted with a cover roll support projection 7 with a projection part 7*a* that will engage the other side of the roll 5 and penetrate between some tissue paper layers at the center of the solid roll.

The frame roll support projection 6 is rotatably mounted in a bearing 6*b* fitted into a bearing holder part 2*c* of the frame 2. The bearing will let the projection part 6*a* rotate freely. The projection part 6*a* should be able to penetrate between the windings of the roll, so it should preferably have a pointed end and a tapered form. It could also have a pointed end and be of constant diameter for most of its length. The projection part normally has a circular cross-section, but other cross-sections could also be used, such as oval, triangular, rectangular. It could also have a central pin with two, three, four or more fins protruding from it. The diameter of the projecting part 6*a* could at the base be 5–9 mm, with a gradual or stepwise tapering to the pointed end with a diameter of 1–2 mm. The length of the protruding part of the projection part 6*a* should be 20–40 mm.

The cover roll support projection 7 is rotatably mounted in a bearing 7*b* fitted into a bearing holder part 3*a* of the cover 3. The bearing will let the projection part 7*a* rotate freely. The projection part 7*a* should be able to penetrate between the windings of the roll, so it should preferably have a pointed end and a tapered form. It could also have a pointed end and be of constant diameter for most of its length. The projection part normally has a circular cross-section, but other cross-sections could also be used, such as oval, triangular, rectangular. It could also have a central pin with two, three, four or more fins protruding from it. The diameter of the projection part could at the base be 3–10 mm, with a gradual or stepwise tapering to the pointed end with a diameter of 1–2 mm. The length of the protruding part of the projection part 7*a* should be 10–25 mm.

The bearing 6*b*,7*b* preferably is a roller bearing, but different kinds of bearings can be used, such as ball bearings, needle bearings, and plain bearings of the self-lubricating type e.g. produced of nylon. Preferred are the types of bearings that will give a certain stability to the frame or cover projection parts 6*a*,7*a*,as roller, needle and plain bearings. When a heavy jumbo roll is installed, the frame bearing 6*b* will have to withstand the momentum from the roll on the projection part 6*a* until the cover 3 is closed.

The frame roll support projection part 6*a* and the cover roll support projection part 7*a* are aligned such that a rotational center line 8 for the roll will be defined. The roll loaded into the dispenser is held securely by the the two projection parts 6*a*,7*a* and is able to rotate freely because of the friction-reducing effect of the bearings 6*b*,7*b*.

The leading part of the paper will be let out through the dispensing opening 9. The opening preferably is equipped with tearing means, such as rounded or triangular teeth. The tearing means can be integral in the dispenser 1 or be in the form of one or more exchangable metal or plastic bar(s) to be fitted in the opening edge. The tearing means is often necessary when the paper roll contains paper without perforations, to enable a user to provide himself with a measured length of paper. Preferably, all three open edges (not along the back plate) of the dispensing opening 9 are equipped with tearing means, so the paper can be pulled in any direction.

Typically, the paper rolls used in the dispenser according to the invention will have a diameter of 120 to 350 mm. The smooth operation of pulling a paper length from a dispenser according to the invention will in many cases enable the use of perforated rolls, especially for lighter rolls. For jumbo rolls, the large inertia will in some cases still necessitate the use of unperforated rolls.

Figure 2:
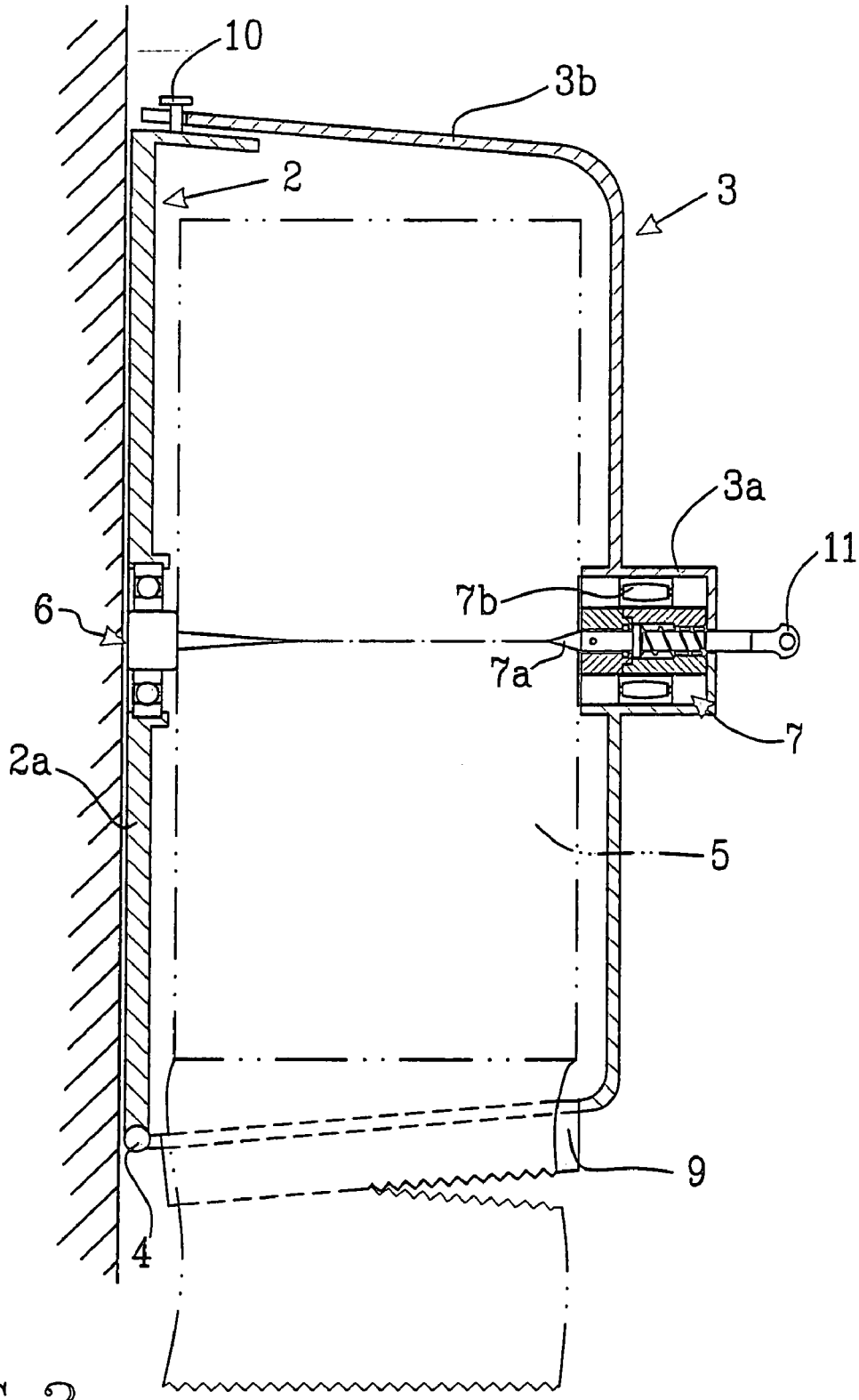
FIG. 2 A view through the vertical center line of a second tissue paper dispenser according to the invention.

In FIG. 2 is shown another embodiment of a dispenser 1 according to the invention. The frame 2 comprises a back plate 2*a* which preferably is equipped with holes for screwing or bolting the dispenser to a wall in a wash room, etc. The cover 3 comprises a front part and a generally circular side wall 3*b*.The cover 3 is connected to the frame by a hinge 4 and movable between an open position, enabling the installation of a new paper roll 5 from which is to be dispensed tissue paper, and a closed position, to be used during the actual dispensing.

Preferably the cover is kept in the closed position by a lock 10, that also protects the dispenser from pilfering.

At the lower part of the side wall there is an opening 9 for dispensing the tissue paper.

This embodiment is equipped with the same frame and cover roll support projections 6,7 as in the first embodiment.

In a preferred embodiment of this second embodiment of the invention the cover roll support projection 7 is additionally adapted with a retractable and catching function, to enable the projection part 7*a* to temporarily be retracted from a roll-engaging position to a non-roll-engaging position, and then be engaged again. See FIGS. 3*a* and 3*b*. The support projection 7 comprises a projection holder 16 that guides the projection part 7*a* which in this embodiment has a cylindrical projection shaft 15. A knob 11 which is integral with the projection shaft 15 and projection part 7*a* and reachable from the outside of the cover 3 can be pulled against the action of a resilient member 12 until a retaining means 13 is caught on a catching means 14. All or most of the point of the projection part 7*a* should then be pulled back inside the protecting line of the inner side of the cover front part 3. In this way the risk of touching the point of the projection part 7*a* when installing a new roll is lessened.

Figure 3A:
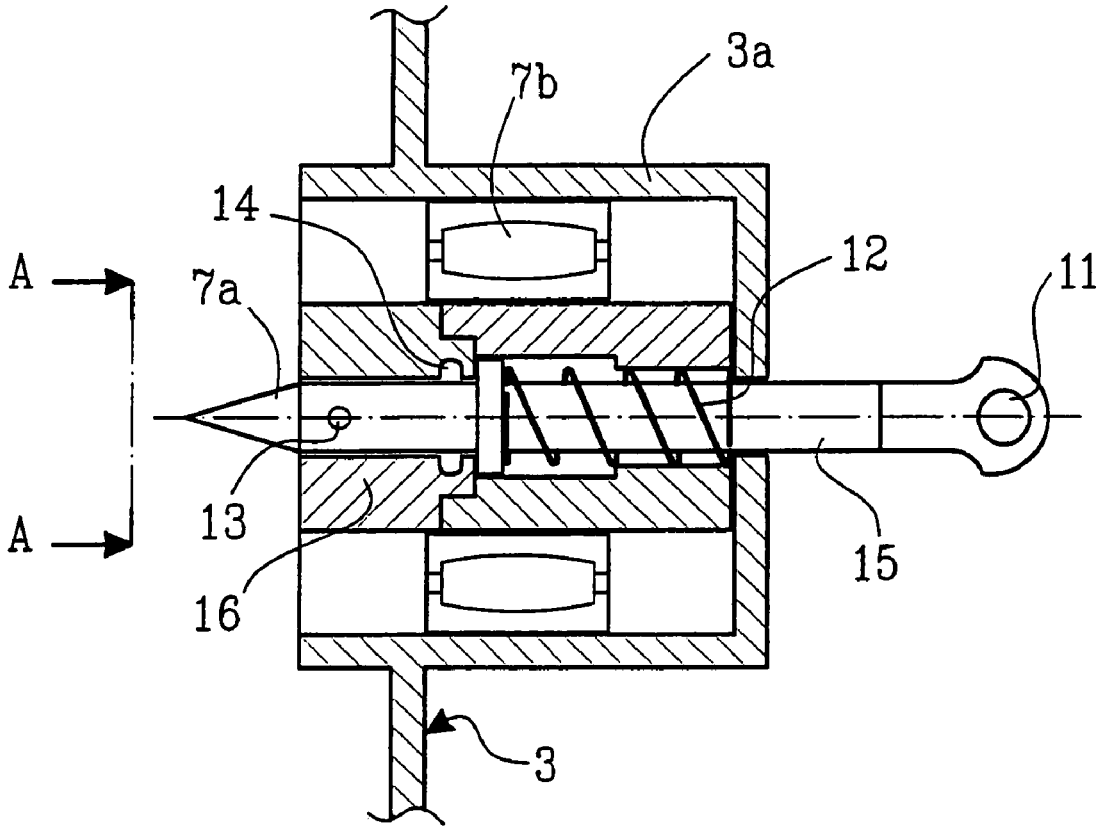
FIG. 3*a* A view of a retracting mechanism for the invention, in the normal state when a roll is engaged to enable tissue paper dispensing.
Figure 3A:
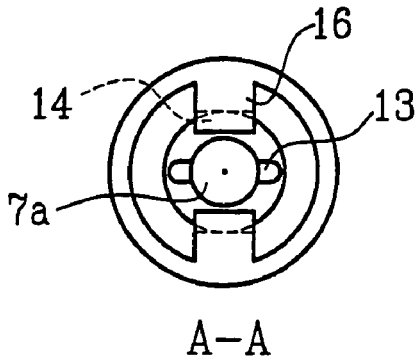
Figure 3B:
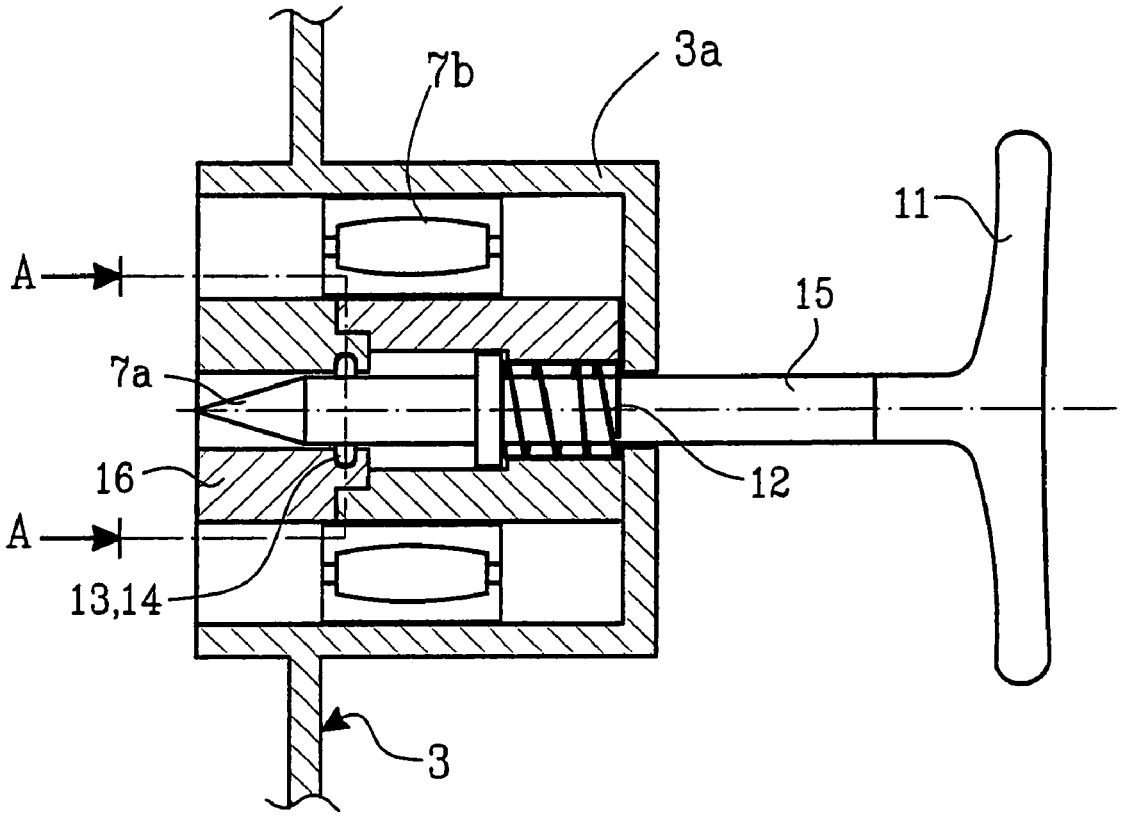
FIG. 3*b* A view of a retracting mechanism for the invention, in the retracted state when it is safe to open the cover for loading a new tissue paper roll.
Figure 3B:
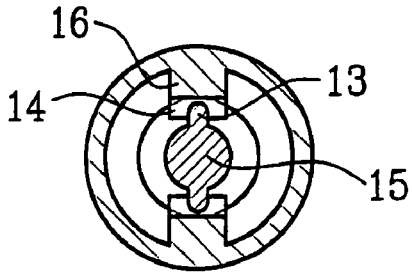

When a new roll 5 is to be installed, the knob 11 is pulled to retract the projection part 7*a* until the retaining means 13 has caught on the catching means 14 and the projection part 7*a* is pulled and held back as can be seen in FIG. 3*b*. The dispenser cover 3 can then be opened and the new roll fitted into place on the frame projection part 6*a*. The direction of rotation of the roll is not important, as the tearing means 9 will work in any direction.

When the cover 3 then has been closed, the knob 11 can be pressed or turned to release the retaining means 13 from the catching means 14, to let the action of the resilient member 12 force the projection part 7*a* to penetrate between the windings of the roll and thus secure a steady grip of the roll as can be seen in FIG. 3*a*.

The resilient member 12 normally is a spring, that is compacted when the knob 11 is pulled.

The retaining means 13 can be a small pin diagonally installed in the projection shaft 15 to extend just outside the shaft 15 adapted to in use being able to be caught on the catching means 14 that in this embodiment consists of two corresponding ledges in the projection holder 16. The catch action will be released by rotating the knob 11.

An alternative way of arranging the retraction, is to equip the projection shaft 15 with small radially extending locating pins adapted to fit into an inclined screw-line in the projection holder 16, such that when the knob 11 and the projection shaft 15 is turned, the pins will ride up the inclined screw-line in the projection holder 16, thereby moving the shaft axially outwards, until the pins can be caught on a plateau in the screw-line. The catch action will be released by turning the knob 11 in the opposite direction. Also in this arrangement, a resilient member 12 is used to force the projection part 7*a* out in its roll-engaging position.

The pins and the inclined screw-line can also be arranged with the pins in the holder and the screw-line in the shaft.

Still an alternative way of arranging the retraction is a commercially available locking pin where the holder 16 at the end facing the knob 11 is arranged with a diagonal slit, and the knob 11 on its underside, facing the holder 16, is arranged with a corresponding ridge, such that when the knob 11 is in a certain rotational position, the ridge will fit into the slit, enabling the knob 11, shaft and projection part 7*a* to enter its roll-engaging position. When the knob 11 is pulled outwards the ridge will disengage from the slit, and the knob 11 with its ridge can be rotated to another rotational position to let the ridge rest on the outer surface of the holder 16, thereby causing the projection part 7*a* to be in a non-roll-engaging position. By turning the knob 11, the ridge will again enter the slit, and the resilient member 12 is used to force the projection part 7*a* out in its roll-engaging position.

The frame and the cover can be made of any suitable material to fit the specific milieu and forces on the different parts. Often the dispenser can be subjected to rough handling in public washrooms and toilets. If jumbo rolls are used the weight of them can be up to 1.5 kg. Preferably a sturdy plastic like ABS, PMMA, PS (polystyrene), PC (polycarbonate) or metal is used. A mixture of construction materials for different parts of the dispenser is also very well suited. A preferred embodiment has a sightline of e.g. polycarbonate in the cover to enable the user and the caretaker to judge if there is enough paper left.

There are also other variants that are to be included in the invention; e.g. the arangement with a retractable projection part is also very suitable to be included in the first embodiment with the side walls as a part of the frame; the roll support projections could be in the form of several smaller projection parts, instead of one larger one.

One also very preferred alternative is to arrange the hinge for the lid to be placed at one side of the dispenser, instead of at the bottom. This is applicable to both the embodiments shown in FIG. 1 and FIG. 2.

Tests have indicated that the invention also can be used for coreless rolls, if the diameter and form of the projection parts are adapted to the specific form that can result from each process of making coreless rolls.

The invention claimed is:

1. A dispenser for solid rolls of web material, comprising:

a frame;

a cover hingedly connectable to the frame, to together with the frame define a volume for storing a roll of web material from which web material can be dispensed;

a frame roll support projection, and a cover roll support projection, the two roll support projections being arranged to enable rotatably engaging the roll of web material at or near a rotational axis of the roll; and an outlet opening in the dispenser, to enable web material to be withdrawn from the dispenser, and wherein at least one of the frame roll support projection and the cover roll support projection is rotatably mounted in a bearing.

2. The dispenser according to claim 1, wherein both the frame and cover roll support projections are rotatably mounted in bearings.

3. The dispenser according to claim 2, wherein the bearings are selected from the group consisting of roller bearings, needle bearings, ball bearings, and plain bearings.

4. The dispenser according to claim 2, wherein at least one of the roll support projections has a projection part, that is adapted to penetrate into the center of the roll.

5. The dispenser according to claim 1, wherein at least one of the roll support projections has a projection part, that is adapted to penetrate into the center of the roll.

6. The dispenser according to claim 5, wherein the projection part has a pointed end and a tapering shape.

7. The dispenser according to claim 5, wherein the projection part has a cross section that is circular, oval, triangular or rectangular.

8. The dispenser according to claim 5, wherein the frame roll support projection has a projection part that has a diameter of 5–9 mm at its base and a length of 25–40 mm.

9. The dispenser according to claim 5, wherein the cover roll support projection has a projection part that has a diameter of 3–5 mm at its base and a length of 5–25 mm.

10. The dispenser according to claim 9, wherein the cover roll support projection part is temporarily retractable from a roll-engaging position to a non-roll-engaging position.

11. The dispenser according to claim 1, wherein the volume is sufficiently large to store jumbo rolls, weighing at least 500 g each.

12. The dispenser according to claim 1, wherein each of the two roll support projections has a projection part that is adapted to penetrate into the center of the roll.

13. The dispenser according to claim 12, wherein each projection part has a pointed end and a tapering shape.

14. The dispenser according to claim 12, wherein each projection part has a cross section that is circular, oval, triangular or rectangular.

15. A dispenser for solid rolls of web material, comprising:

a frame;

a cover hingedly connectable to the frame, to together with the frame define a volume for storing a roll of web material from which sheets of web material can be dispensed;

a frame roll support projection connected to said frame and having a substantially rigid projection part that is adapted to pierce a center of the roll;

a cover roll support projection connected to said cover and having a substantially rigid projection part that is adapted to pierce a center of the roll; and an outlet opening in the dispenser, to enable web material to be withdrawn from the dispenser.

16. The dispenser according to claim 15, wherein said projection parts each have a pointed end and a tapering shape.

17. The dispenser according to claim 16, wherein said projection parts each have cross sections that are circular, oval, triangular or rectangular.

18. The dispenser according to claim 15, wherein said cover roll support projection part is temporarily retractable from a roll-engaging position to a non-roll-engaging position.

19. A dispenser for solid rolls of web material, comprising:

a frame;

a cover hingedly connected to the frame, to together with the frame define a volume for storing a roll of web material from which web material can be dispensed;

a frame roll support projection connected to said frame;

a cover roll support projection connected to said cover, said cover roll and frame roll support projections being arranged to rotatably engage the roll of web material at or near a rotational axis of the roll; and an outlet opening in the dispenser, to enable web material to be withdrawn from the dispenser;

wherein at least one of the frame roll support projection and the cover roll support projection is rotatably mounted in a bearing; and wherein each of the frame roll support projection and the cover roll support projection has a projection part that is adapted to pierce the center of the roll.

20. The dispenser according to claim 19, wherein said cover roll support projection part is temporarily retractable from a roll-engaging position to a non-roll-engaging position.

* * * * *